US007077623B2

(12) United States Patent
Guemmer

(10) Patent No.: US 7,077,623 B2
(45) Date of Patent: Jul. 18, 2006

(54) FLUID FLOW MACHINE WITH INTEGRATED FLUID CIRCULATION SYSTEM

(75) Inventor: Volker Guemmer, Mahlow (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 0 days.

(21) Appl. No.: 10/622,135

(22) Filed: Jul. 18, 2003

(65) Prior Publication Data

US 2004/0081552 A1 Apr. 29, 2004

(30) Foreign Application Priority Data

Jul. 20, 2002 (DE) ..... 102 33 032

(51) Int. Cl.
*F01D 25/24* (2006.01)

(52) U.S. Cl. ..... 415/58.5; 415/115; 415/117

(58) Field of Classification Search ..... 415/58.1–58.8, 415/26, 19, 8.1, 199.1–199.5, 47–50, 115–118, 415/176–180; 60/39.75, 39.25, 39.17
See application file for complete search history.

(56) References Cited

U.S. PATENT DOCUMENTS

| | | | | |
|---|---|---|---|---|
| 2,870,957 A | | 1/1959 | Stalker | |
| 2,933,238 A | * | 4/1960 | Stalker | 415/58.1 |
| 3,572,960 A | | 3/1971 | McBride | |
| 5,305,599 A | * | 4/1994 | Marvin | 60/226.3 |
| 5,468,123 A | * | 11/1995 | Guimier et al. | 415/178 |
| 5,611,197 A | * | 3/1997 | Bunker | 60/806 |
| 5,768,893 A | * | 6/1998 | Hoshino et al. | 60/682 |
| 5,782,076 A | * | 7/1998 | Huber et al. | 60/782 |
| 6,065,282 A | * | 5/2000 | Fukue et al. | 60/39.182 |
| 6,378,287 B1 | * | 4/2002 | Griffiths | 60/39.17 |
| 6,574,965 B1 | * | 6/2003 | Feulner | 60/785 |
| 6,582,183 B1 | * | 6/2003 | Eveker et al. | 415/1 |

FOREIGN PATENT DOCUMENTS

| | | |
|---|---|---|
| DE | 1428188 | 11/1968 |
| DE | 1964057 | 7/1970 |
| DE | 1815229 | 8/1970 |
| DE | 2352236 | 4/1975 |

OTHER PUBLICATIONS

German Search Report dated Feb. 3, 2003.

* cited by examiner

*Primary Examiner*—Edward K. Look
*Assistant Examiner*—Dwayne J White
(74) *Attorney, Agent, or Firm*—Timothy J. Klima

(57) ABSTRACT

A fluid-flow machine includes at least one rotor and a free number of stators flown by a fluid, with at least one blade thereof positioned on throat-confining surfaces provided with both a device for fluid removal from the flow path and a device for fluid supply into the flow path (bi-functionality). The machine includes at least one line associated with the device for fluid removal for returning the removed fluid to an upstream position in the flow path and at least one further line associated with the device for fluid supply for supplying the fluid from a further downstream position in the flow path.

25 Claims, 8 Drawing Sheets

FLUID FLOW MACHINE WITH INTEGRATED FLUID CIRCULATION SYSTEM

This application claims priority to German Patent Application DE10233032.8 filed Jul. 20, 2002, the entirety of which is incorporated by reference herein.

This invention relates to a fluid-flow machine with an integrated fluid circulation system.

BACKGROUND OF THE INVENTION

The aerodynamic loadability of components of a fluid-flow machine, for example fans, compressors, pumps and blowers, is limited by the growth and the separation of profile boundary layers on the blade surfaces and side-wall boundary layers forming on the hub and the casing.

For fans, compressors, pumps and blowers, the state of the art only restrictively provides concepts for the internal guidance of a fluid drawn off at particularly favorable locations and the re-introduction of this fluid into the main flow path at again particularly favorable locations.

The state of the art mostly shows solutions in which a drawn-off fluid quantity is permanently removed from the main flow path of the fluid either by making use of an existing pressure difference or by means of an external pump. This is accomplished either at the axial gap between two blade rows or on surfaces of the blade row itself. Solutions also exist in which the fluid is supplied at the axial gap or to a blade row from an external source.

Some solutions are known in which continuous fluid circulation takes place only on a single blade, for example a rotor blade, with fluid being drawn off from the surface of the blade and re-introduced at the same blade in the blade tip area.

Other concepts known from the state of the art provide for a non-continuous re-circulation of fluid from the rearward to the forward stages of a compressor in order to influence stage de-tune during part-load operation. In these cases, the exchange of fluid is restricted to the axial gaps between the blade rows of the fluid-flow machine.

Other state-of-the-art solutions provide for continuous fluid circulation between different blade rows of a compressor. In these cases, the existing pressure difference is used to remove fluid from a downstream blade row or a downstream axial gap and to re-introduce it at an upstream blade row.

Extraction of fluid on rotors and stators and its transfer to a location outside the flow paths of the fluid-flow machine is shown in U.S. Pat. Nos. 2,720,356, 5,904,470, EP 1 013 937 A2 and DE 1 815 229 A.

Continuous fluid circulation within individual rotor blades is known from U.S. Pat. No. 5,480,284.

Continuous re-circulation of fluid between axial gap and blade row is known from Specification DE 1 428 188 A, while re-circulation from blade row to blade row is shown in U.S. Pat. Nos. 2,749,027, 2,933,238 and U.S. Pat. No. 2,870,957.

The solutions known from the state of the art are characterized by a variety of considerable disadvantages.

Those of the existing concepts which are intended to achieve additional stabilization of the flow in the fluid-flow machine by boundary layer extraction or fluid introduction completely neglect the aspect of a circulation of secondary fluid quantities between the surfaces of different blade rows of the fluid flow machine. Fluid is mostly removed permanently from the main flow path or supplied from an external source—in some cases even by the input of additional energy.

Both an additional energy input and a loss in mass flow will impair the thermodynamic process of the overall system surrounding the fluid-flow machine. Such overall systems include, for example, gas turbines, aircraft engines, power stations and the like. Some concepts make use of a recirculation from blade row to blade row, but with each blade row being limited to either the removal or the supply of fluid.

None of the existing concepts provides for bi-functional flow control on one and the same blade row, i.e. a combination of fluid removal and fluid supply and, hence, a highly effective combination of boundary layer extraction and fluid introduction. An integrated circulation system which provides for recurrent bi-functional flow control via several stages of a fluid-flow machine does not exist either.

BRIEF SUMMARY OF THE INVENTION

In a broad aspect, the present invention provides a fluid-flow machine which is characterized by simple design, small number of parts, cost-effective producibility and exceptionally high aerodynamic loadability, while avoiding the disadvantages of the state of the art.

It is a particular object of the present invention to provide solution to the above problems by the combination of the features described herein, with further objects and advantages of the present invention becoming apparent from the description below.

The present invention relates to fluid-flow machines, such as fans, compressors, pumps and blowers, of the axial, semi-axial or centrifugal type using gaseous or liquid working media (fluids). The fluid-flow machine comprises one or several stages. Each stage normally consists of a rotor and a stator, in some cases only a rotor exists. The rotor comprises a number of blades which are connected to the rotating shaft of the fluid-flow machine and transfer energy to the working medium. The rotor may be designed with or without a shroud at the outward blade ends. The stator comprises a number of stationary blades which have either a shroud on both ends or a free end on the hub side. The fluid-flow machine is normally enclosed by a casing, in other cases (e.g. aircraft or ship propellers) no such enclosure exists. The fluid-flow machine may feature a stator (inlet guide vanes) upstream of the first rotor. Alternatively, at least one stator blade or inlet guide vane row may be of the variable type and be actuated via a spindle accessible from outside. The fluid-flow machine may, in a special form, also be provided with at least one row of variable rotor blades.

In alternative configuration, multi-stage types of said fluid-flow machine may have two counter-rotating shafts, with the direction of rotation of the rotor blade rows alternating between stages. Here, no stators exist between subsequent rotors. Finally, the fluid-flow machine can have a bypass configuration, with the single-flow annulus dividing into two concentric annuli behind one of the blade rows and with each of these annuli housing at least one blade row.

In accordance with the present invention, at least one blade row of the fluid-flow machine (rotor or stator) is provided with both a device for the removal of fluid from the main flow path and a device for the supply of fluid into the main flow path (bi-directional flow control). In this arrangement, at least one line allied to the removal device exists by which the removed fluid is transferred to a further upstream point in the main flow path. Similarly, the supply device is connected to at least one line to which fluid is transferred from a point further downstream in the main flow path. Accordingly, the connection of several blade rows by the operating principle according to the present invention will create an integrated fluid circulation system which is recurrent over several stages of the fluid-flow machine.

The central object of the present invention, therefore, is an integrated system for continuous fluid circulation which provides for bi-functional flow control on at least one blade row and accordingly differs from the solutions known from the state of the art by its concept, its efficiency and its recurrence over several stages of the fluid-flow machine.

In accordance with the present invention, at least one device for fluid removal and at least one device for fluid supply on throat-confining surfaces are provided on at least one blade row of the fluid-flow machine. Preferably, this feature is provided recurrently over several blade rows in such a manner that a device for fluid removal on at least one blade of at least one stator or rotor row connects via at least one line to a device for fluid supply situated at an upstream point of the flow path on at least one blade of at least one stator or rotor row.

The lines according to the present invention either provide for free flow of the fluid or, alternatively, are fitted with fixed or variably adjustable restrictors.

It can further be advantageous if the line for the collection of the fluid quantities removed from individual blades of the fluid-flow machine is provided with a discharge chamber into which individual lines issue or from which the line or several lines go out, with this discharge chamber being preferably situated on the periphery of the main flow path. In a similar manner, a supply chamber may be provided. Both the discharge and the supply chamber serve the steadiness of the fluid flow and the associated pressure compensation, as necessary.

BRIEF DESCRIPTION OF THE DRAWINGS

The present invention is more fully described in the light of the accompanying drawings showing preferred embodiments. In the drawings.

DETAILED DESCRIPTION OF THE INVENTION

Figure 1:
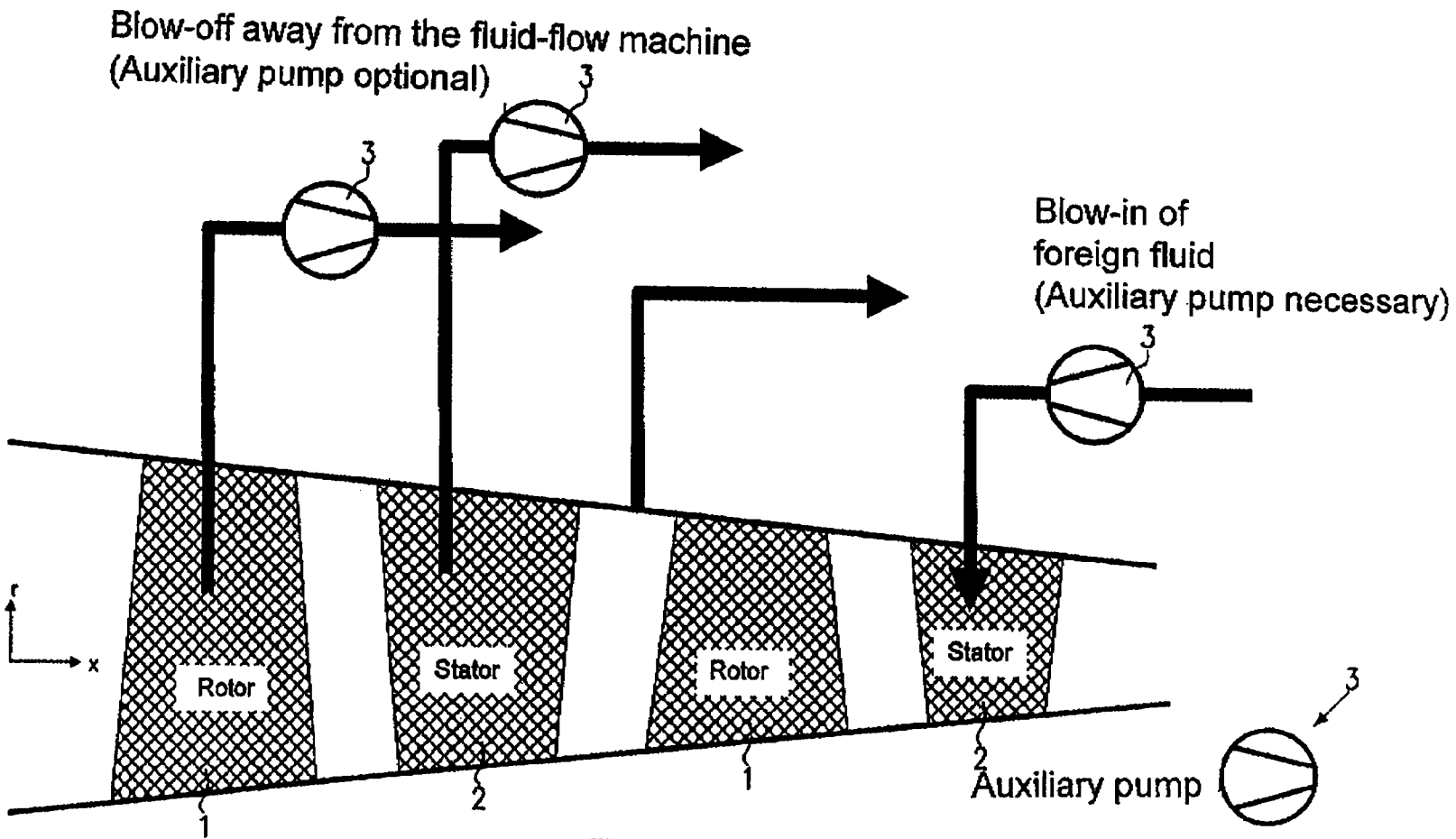
FIG. 1 is a schematic representation of the solutions for the fluid removal and supply known from the state of the art.

FIG. 1 shows schematically the solutions known from the state of the art for fluid removal or fluid supply, respectively. As shown, fluid is blown off from a rotor or a stator (rotor blade or stator blade) and away from the fluid-flow machine. An auxiliary pump 3 can be used for this purpose. It is further known to supply fluid from an external source, for example an auxiliary pump, to a rotor or a stator.

Figure 2:
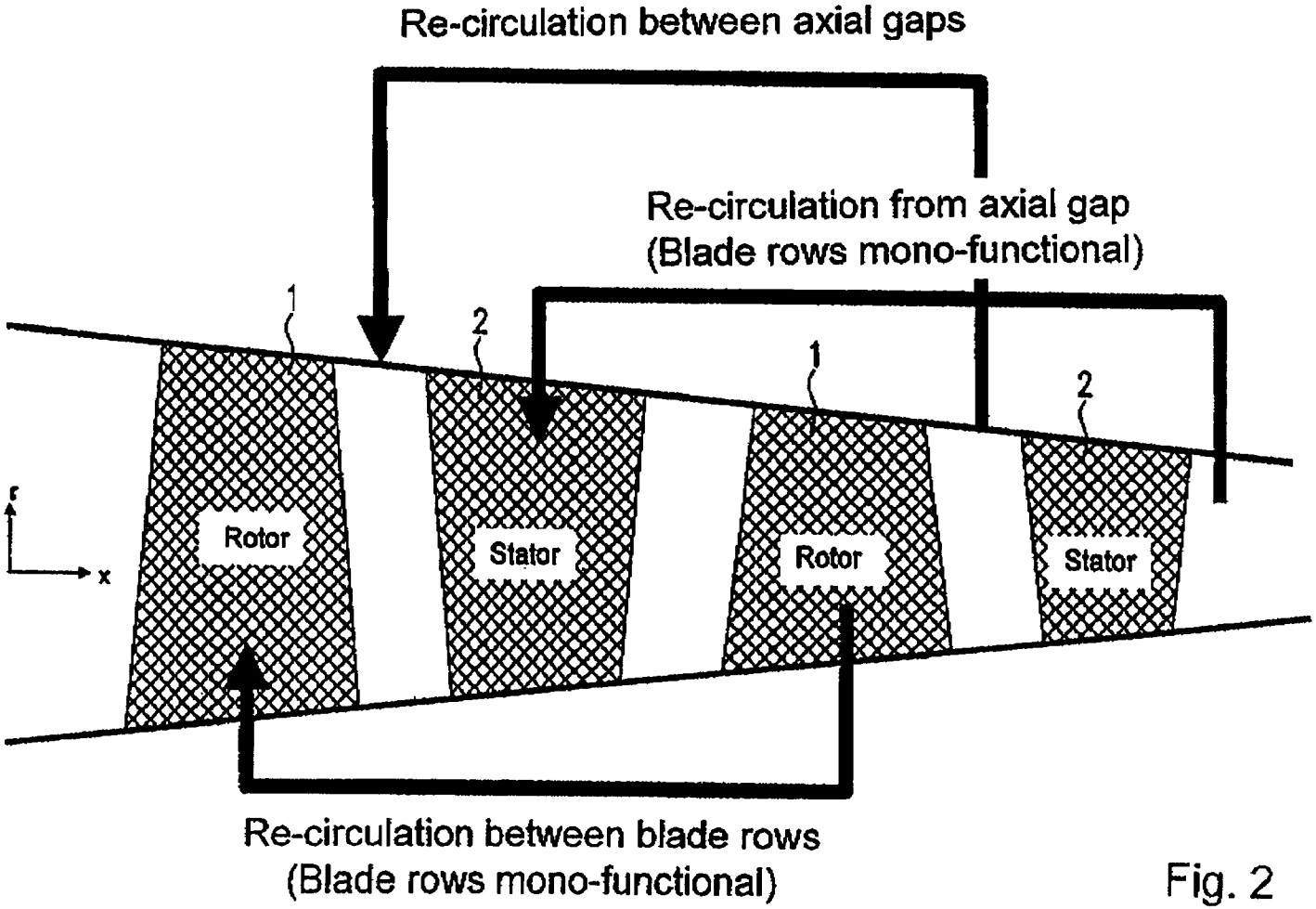
FIG. 2 is a schematic representation of the solutions for fluid circulation known from the state of the art.
Figure 3A:
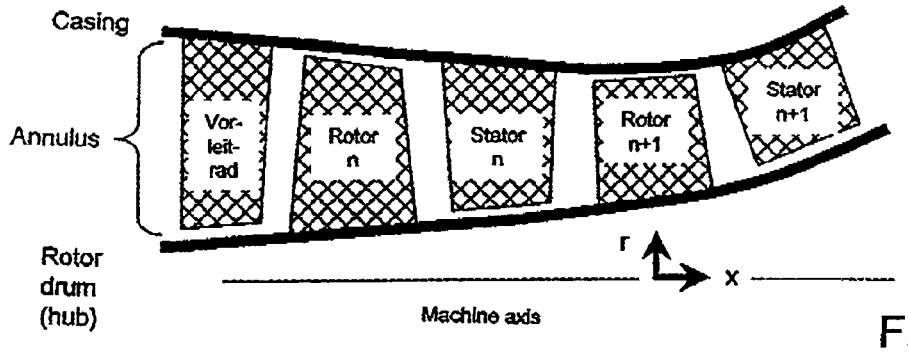
FIG. 3 is a representation of some possible configurations of the fluid-flow machine.
Figure 3B:
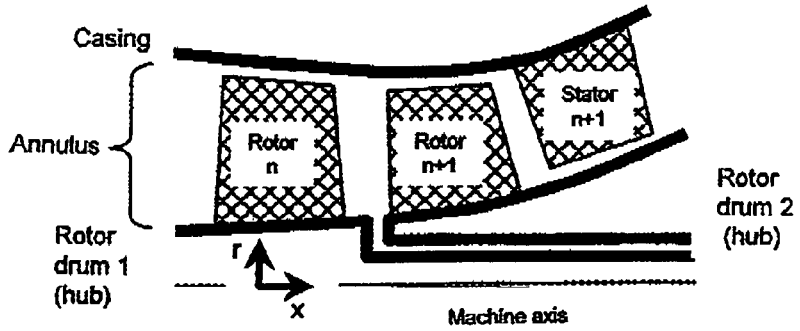
Figure 3C:
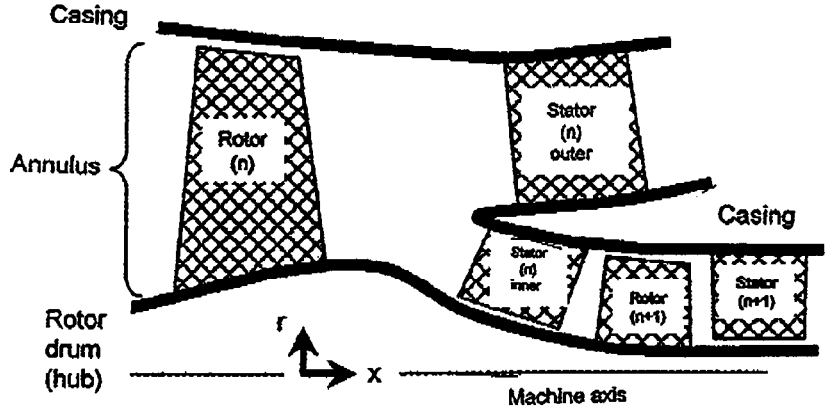
Figure 3D:
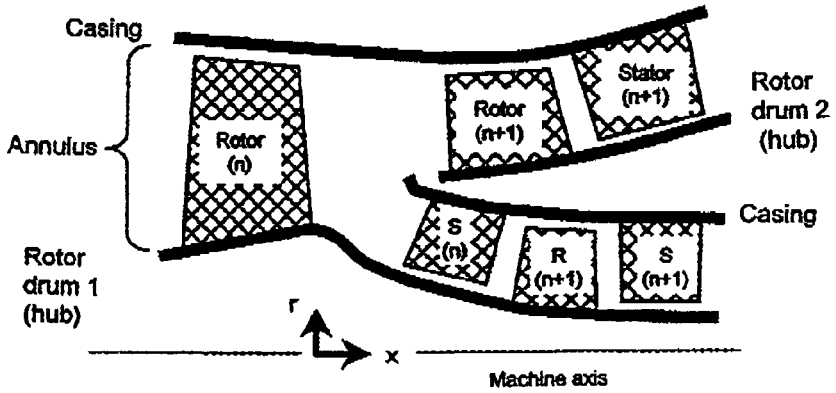

FIG. 2 shows further solutions according to the state of the art. These include re-circulation between axial gaps, re-circulation between axial gap and blade row (rotor or stator) and re-circulation between blade rows (rotor or stator).

FIG. 3 illustrates the scope of application of the present invention by way of some possible configurations of the main flow path of the fluid-flow machine in accordance with the present invention, with integrated fluid circulation system.

Figure 4:
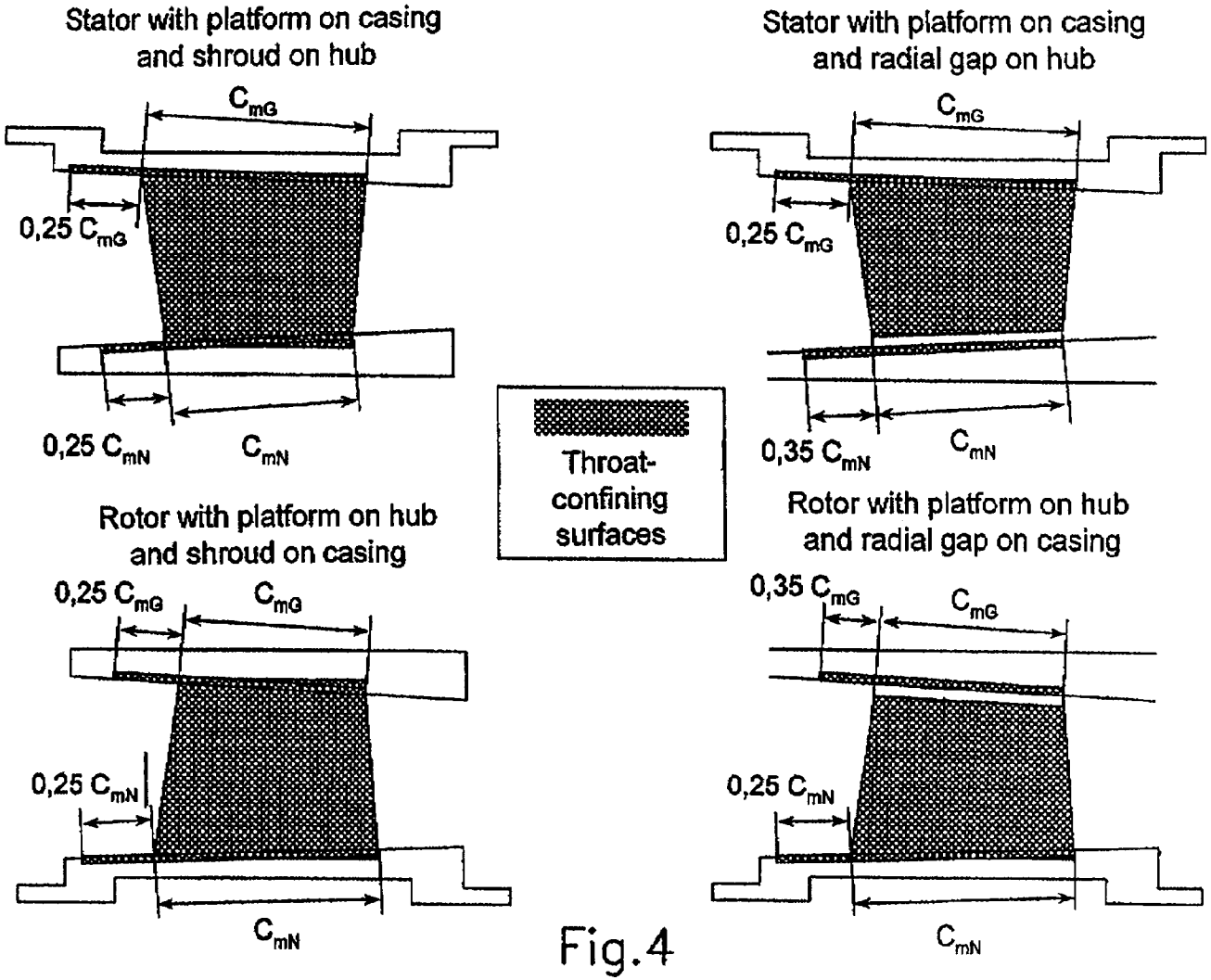
FIG. 4 is the definition of the throat-confining surfaces essential for understanding the present invention.

FIG. 4 shows definitions of the term "throat-limiting surfaces" as used in the present invention. The indications in FIG. 4 reflect the differences in the dimensioning and arrangement of the individual areas.

Figure 5:
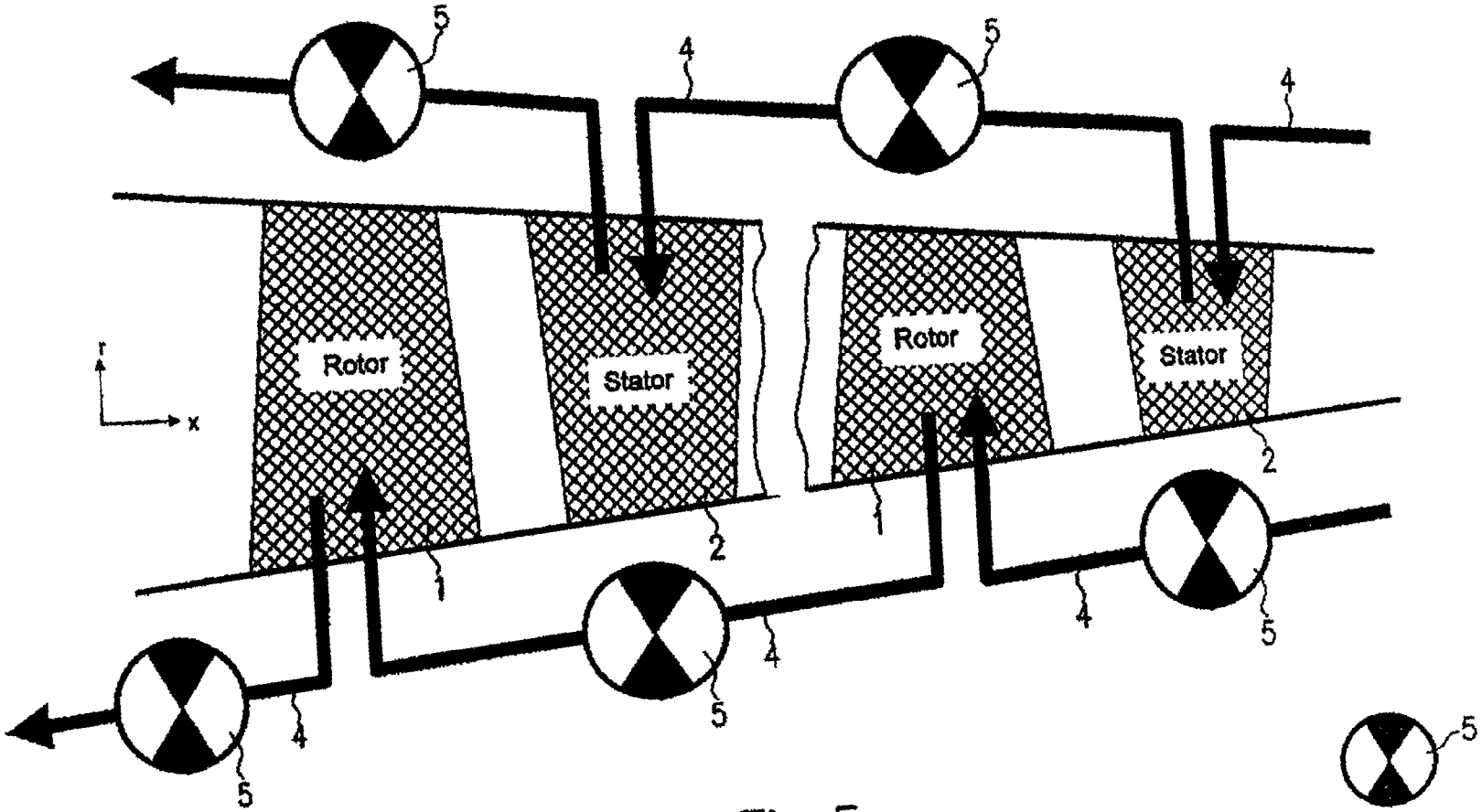
FIG. 5 is a schematic representation of the solution concept in accordance with the present invention.

FIG. 5 shows in schematical representation a possible form of the inventive concept with continuous fluid circulation. As is apparent, the circulation lines are each provided alternately between rotors 1 and stators 2 to provide the blade rows with the bi-functionality according to the present invention. The schematically shown line 4 in each case enables fluid to be drawn off or discharged, to be transferred to a point upstream the flow path of the fluid-flow machine and to be re-introduced at this upstream point. Fluid removal and fluid supply can take place either on a rotor or on a stator (or a blade thereof), with the fluid entering or exiting via recesses in blades of the rotor or stator, these recesses not being shown in detail. As shown in FIG. 5, line 4 connects either stators or rotors, but it is also possible to remove fluid from a rotor and to supply it to a stator or to remove fluid from a stator and supply it to a rotor in order to establish bi-functionality (simultaneous fluid removal and supply) of one or several blade rows. The type of fluid supply into the main flow path upstream of a bi-functionally supplied blade row, or a sequence of bi-functionally supplied blade rows, as well as the type of fluid removal from the main flow path downstream of a bi-functionally supplied blade row, or a sequence of bi-functionally supplied blade rows, is optional.

Alternatively, a restrictor 5 may be provided in line 4, which, if applicable, can be of a variable type, to enable adaptation of the inventive arrangement to the various operating states of the fluid-flow machine.

According to the present invention, fluid is removed from the flow path of the fluid-flow machine via throat-confining surfaces on at least one blade of at least one rotor or stator row 1, 2, with the fluid being collected and routed to at least one, further upstream blade row and being introduced into the flow path of the fluid-flow machine via throat-confining surfaces on at least one blade of a rotor or stator row 1 or 2, respectively. Fluid transfer from the removal point to the supply point is accomplished via the line 4, with the line/chamber flow area being unrestricted, or, in a restrictable manner, via an optionally variable restrictor 5 provided in the transfer path or the line 4, respectively. With a removal point and a supply point always existing together on at least one blade of a rotor or stator row, the circulation system according to the present invention enables fluid flow to be controlled in a bi-functional manner, i.e. to provide bi-functionality.

As illustrated in FIG. 4, throat-confining surfaces in the context of the present invention are all surfaces of the blade itself (suction side, pressure side, leading and trailing edge), surfaces on a hub and casing of the fluid-flow machine located between the leading and the trailing edge of the blade row under consideration, surfaces on the hub or casing with firm connection to the blade (blade platforms, shrouds, blisk or bling configurations) between a point located 25% of the local meridional blade chord length (CmG or CmN, respectively) before the leading edge and the leading edge itself, and/or surfaces on the hub or casing without firm connection to the blade (free rotor or stator ends) between a point located 35% of the local meridional blade chord length (CmG or CmN, respectively) before the leading edge and the leading edge itself.

The embodiments of FIGS. 6 and 7 will now be discussed.

Figure 6:
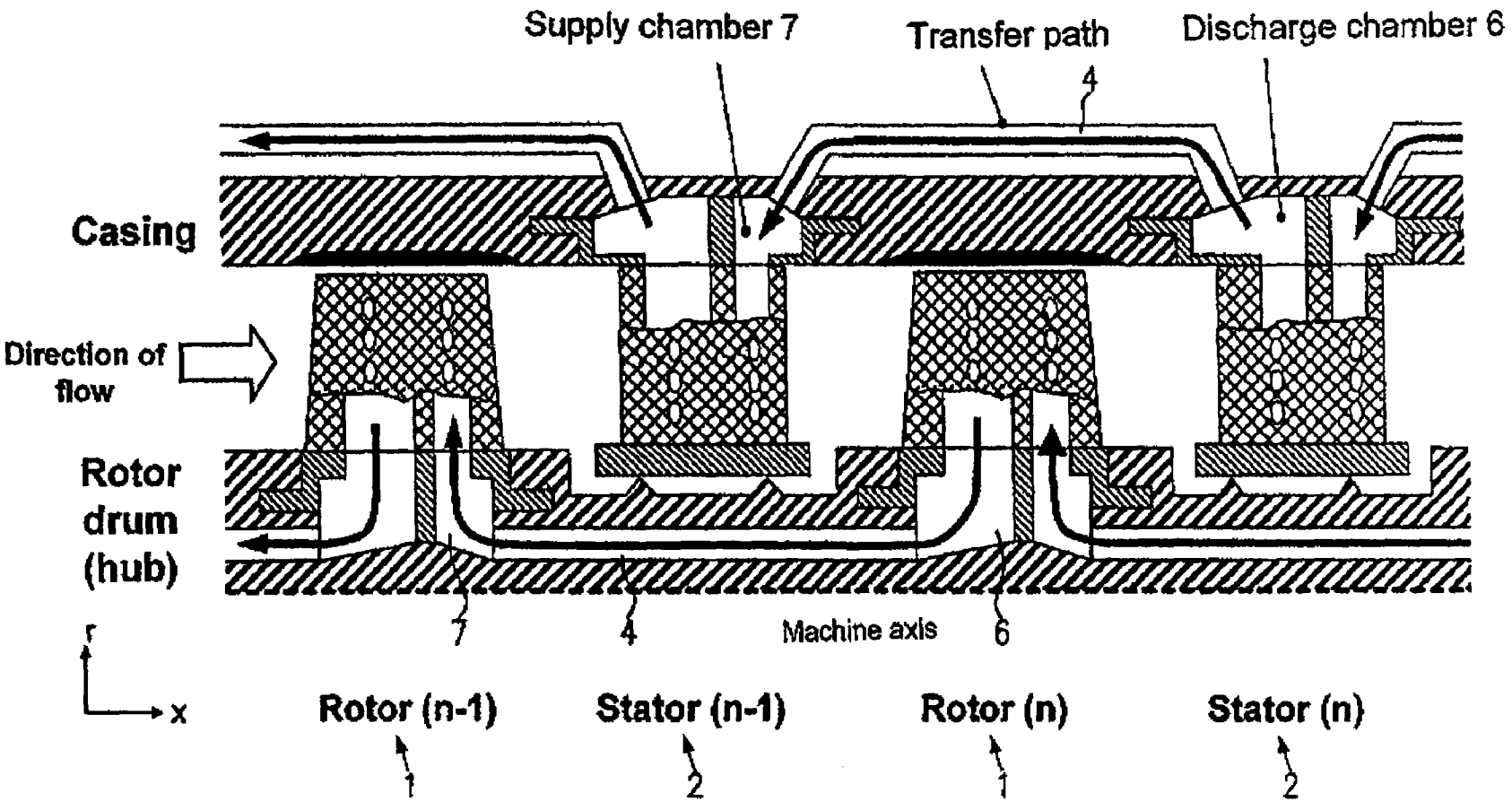
FIG. 6 is an embodiment of the fluid circulation system in accordance with the present invention.

FIG. 6 shows a fluid discharge chamber 6 with optional form provided on or in a casing (not further detailed) of a fluid-flow machine which connects to the line 4 and communicates with at least one opening on throat-confining surfaces of at least one blade of a stator row or of a stator 2, respectively. Also, the line 4 is arranged in the area of the casing and establishes a transfer path. Provision is made for at least one line 4 and/or one discharge chamber 6. Line 4 issues into a fluid supply chamber 7 provided in or on the casing whose dimensions and form are designable in a variable way and which connects to at least one opening on a throat-confining surface of at least one blade of a further upstream stator row or of a stator 2, respectively. In order to provide the bi-functionality according to the present invention, at least one blade of at least one of the stator rows included in the fluid circulation system possesses a number of openings on throat-limiting surfaces of which a part connects to a discharge chamber 6 and the remaining part to a supply chamber 7.

Alternatively or in combination therewith, FIG. 6 shows in its lower part a design variant in which the discharge chamber 6, the lines 4 and the supply chamber 7 are related to individual rotor rows. Here, the lines 4 are provided in or on the rotor drum or hub, respectively. In order to provide the bi-functionality according to the present invention, at least one blade of at least one of the rotor rows included in the fluid circulation system possesses a number of openings on throat-limiting surfaces of which a part connects to a discharge chamber 6 and the remaining part to a supply chamber 7.

Figure 7:
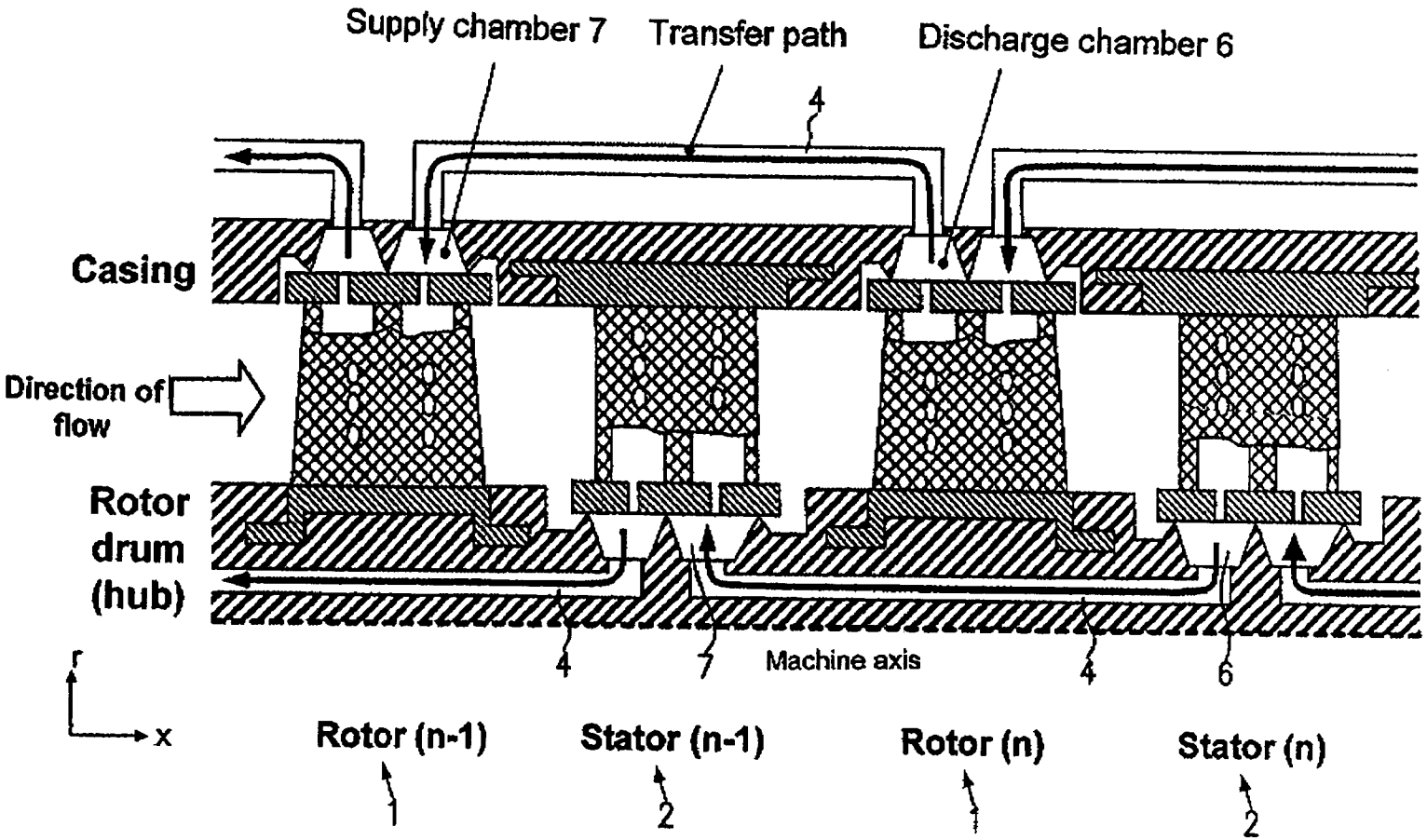
FIG. 7 is an alternative embodiment, analogically to FIG. 6.

FIG. 7 shows an alternative design in which a fluid discharge chamber 6 of optional form provided in or on the rotor drum connects to at least one opening on a throat-confining surface of at least one blade of a stator row 2. Also, a transfer path (line 4) situated in the rotor drum and comprising at least one line and/or a chamber of optional form is provided which connects to the fluid discharge chamber 6. A fluid supply chamber 7 of optional form is provided in or on the rotor drum which connects to at least one opening on a throat-confining surface of at least one blade of a further upstream stator row 2. In order to provide the bi-functionality according to the present invention, at least one blade of at least one of the stator rows included in the fluid circulation system possesses a number of openings on throat-limiting surfaces of which a part connects to a discharge chamber 6 and the remaining part to a supply chamber 7.

Furthermore, FIG. 7 shows an alternative or also additional arrangement in which a fluid discharge chamber 6 of optional form situated in or on the casing connects to at least one opening on a throat-confining surface of at least one blade of a rotor row 1. A transfer path (line 4) is provided in or also on the casing. This transfer path, as in the other embodiments, comprises at least one line and/or chamber of optional form which connects to at least one opening on throat-confining surfaces of at least one blade of a further upstream rotor row 1. In order to provide the bi-functionality according to the present invention, at least one blade of at least one of the rotor rows included in the fluid circulation system possesses a number of openings on throat-limiting surfaces of which a part connects to a discharge chamber 6 and the remaining part to a supply chamber 7.

As becomes apparent from the above, a multitude of design variants and combinations for the transfer of fluid exists to establish bi-functionality on one or several blade rows. As shown in FIG. 6 and FIG. 7, fluid is transferred either from rotor to rotor or from stator to stator or from rotor to stator or from stator to rotor, respectively, with the line 4 being provided either on or in the casing or on or in the rotor drum (hub), respectively. As becomes further apparent from the above, the fluid may also be transferred to a position further than the next rotor of stator row. Accordingly, the present invention provides for a great variety of combinations.

Figure 8:
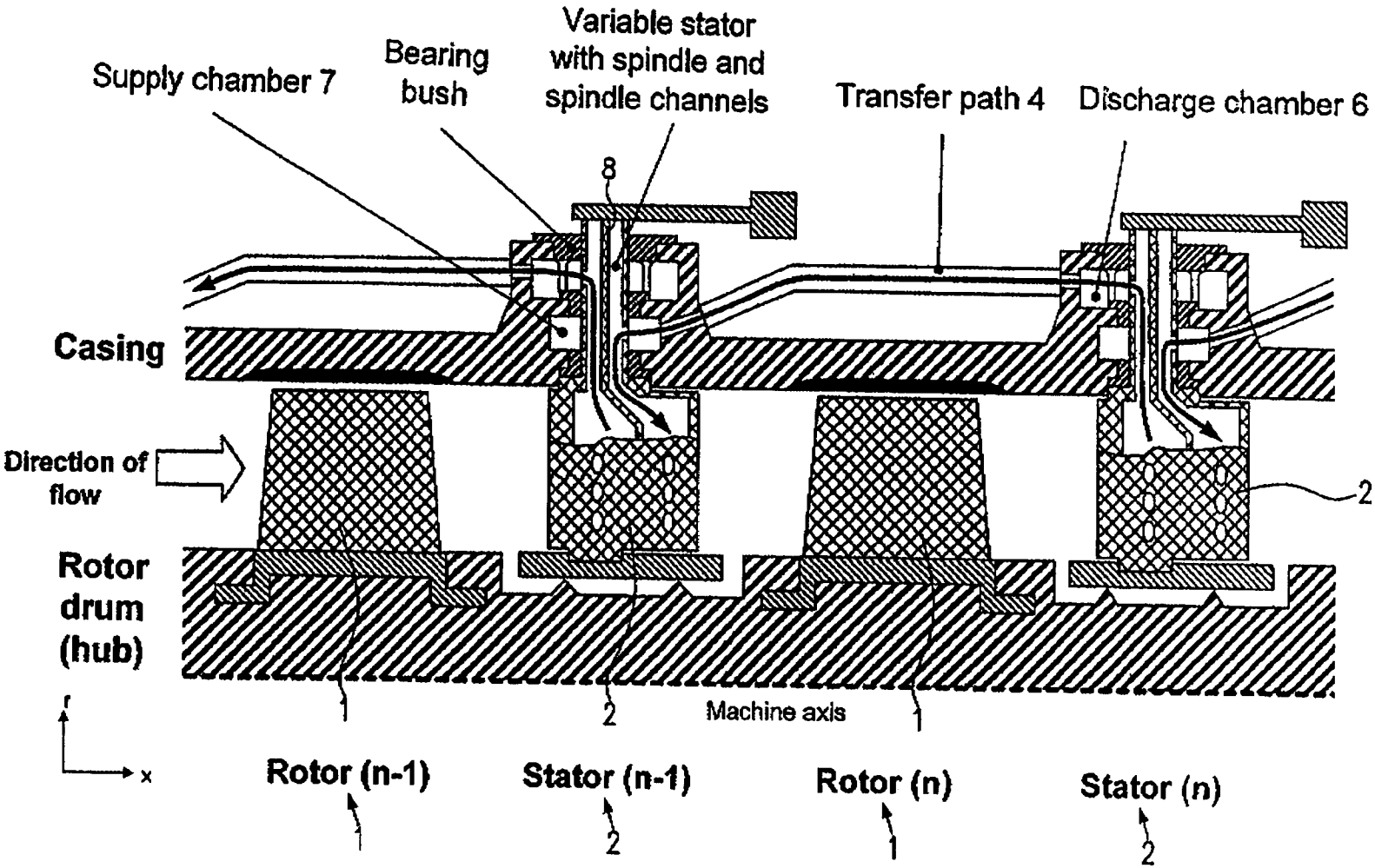
FIG. 8 is an embodiment with variable-type stator blading.

FIG. 8 shows an embodiment with a variable stator blade of a stator 2, which can also be an inlet guide vane. This stator blade possesses the bi-functionality in accordance with the present invention, as described above. The stator blade consists of a profiled airfoil and a spindle 8 connected to said airfoil, which extends through the casing of the fluid-flow machine to the outside where it is connectable to any actuating mechanism. The spindle 8 is borne rotatably around its own axis on or in the casing and may have any cross-section along its axis. The spindle is hollow and has two channels which extend over the whole or over a part of its length and are located either adjacent to or in each other. One of said channels of spindle 8 is used for the supply of fluid to the blade and, for this purpose, is provided with a sideward or top-end inlet, enabling fluid to enter from the fluid supply chamber 7. For further routing of the fluid, this spindle channel connects to at least one opening on surfaces of the variable stator blade via at least one cavity in the blade interior. The other of said spindle channels connects to at least one opening on surfaces of the variable stator blade via at least one cavity in the blade interior. This spindle channel serves the discharge of fluid from the blade and, for this purpose, is provided with a sideward or top-end outlet enabling fluid to exit into the fluid discharge chamber 6. The spindle 8 can be borne in the casing either directly or by means of at least one sleeve bearing. In the embodiment shown, a total of three such bearing sleeves is provided.

Alternatively to the solution illustrated in FIG. 8, and in accordance with the present invention, a variable, bi-functional stator blade may have a further, inward spindle located in a stationary area on the hub of the fluid-flow machine, besides the spindle located on the casing. Here, it may be advantageous if the discharge of fluid is effected via a spindle channel leading outwards to the casing and a communicating discharge chamber on the casing, while the supply of fluid is accomplished via a spindle channel coming from the hub and a communicating supply chamber on the hub. It may also be advantageous if the supply of fluid is accomplished via a spindle channel coming from the casing and a communicating supply chamber on the casing, while the discharge of fluid is effected via a spindle channel leading inwards to the hub and a communicating discharge chamber on the hub. Finally, with the shaft being borne in the area of the hub and irrespective of the existence, or otherwise, of an outer spindle, fluid supply and discharge in accordance with the present invention can be effected via spindle channels leading to the hub and located adjacent to or in each other and via fluid supply and discharge chambers also located on the hub. The rules of design set out above for the case "fluid supply and fluid discharge on the casing" will apply here similarly.

As becomes apparent from the above explanations, the fluid-flow machine with the fluid circulation system, both machine and system being in accordance with the present invention, provides for a hitherto unequaled degree of active boundary layer control on fluid-flow machines of the most different types, such as fans, compressors, pumps, blowers, aircraft and ship propellers.

The fluid-circulation system according to the present invention is of the continuous-active type and significantly increases the aerodynamic loadability of the fluid-flow machine over a wide operating range.

Furthermore, the inventive arrangement leads to a significantly smaller size of the entire fluid-flow machine. The fluid circulation system in accordance with the present invention is automotive and does not require any energy input from outside of the fluid-flow machine. The completely module-internal process of fluid circulation avoids fluid mass losses between the inlet and the outlet of the fluid-flow machine. Thus, effective re-use of the fluid drawn off at another point of the fluid-flow machine is ensured.

The present invention is further advantageous in that the inventive bi-functionality, in particular, of one blade row or several blade rows gives rise to a highly intense exchange of fluid between throat-confining surfaces, i.e. those surfaces which are substantially allied to boundary layer formation and loss formation in the machine. Systematic recurrence along the stages of the fluid-flow machine and interaction of one or several fluid removal/supply schemes provide for significantly enhanced aerodynamic loadability of all blade rows of the fluid-flow machine (rotors and stators).

Depending on the variant and development of the present invention, the loadability of the fluid-flow machine can be enhanced by a factor of 1.5 to 2.5. For a given pressure ratio of the fluid-flow machine and with efficiency being maintained or improved by up to 2 percent, the number of components installed can be reduced by approximately 50 percent compared to a conventional fluid-flow machine. Thus, a cost reduction by approximately 20% is achievable.

If the solution according to the present invention is used in compressors of aircraft engines of 25,000 pound thrust, for example, a reduction of the specific fluid consumption up to 1 percent is achieved.

The present invention accordingly presents a novel and highly effective means for significantly increasing the load and performance values of fluid-flow machines. Special forms of fluid-flow machines with integrated fluid circulation system were presented in detail; it will be appreciated, however, that many details may differ from the embodiments illustrated. Moreover, attention is drawn to the fact that a plurality of modifications other than those described may be made without departing from the inventive concept. Various aspects of the different embodiments can be combined in different manners to create new embodiments.

What is claimed is:

1. A fluid-flow machine, including:

at least one rotor row and a plurality of stator rows each having external surfaces positioned in a fluid flow, at least one blade thereof which is positioned on throat-confining surfaces, the at least one blade including both a device for fluid removal from the fluid flow in an area of the external surface of the blade and a device for fluid supply into the fluid flow in the area of the external surface of the blade, at least one line associated with the device for fluid removal for returning the removed fluid to an upstream position in the fluid flow, and at least one further line associated with the device for fluid supply for supplying the fluid from a further downstream position in the fluid flow.

2. A fluid-flow machine in accordance with claim 1, wherein the device for fluid removal is provided on at least one blade of at least one of a stator and a rotor first row of blades and connects via at least one line to a device for fluid supply on at least one blade of at least one of a stator and rotor further row of blades.

3. A fluid-flow machine in accordance with claim 1, wherein the device for fluid supply is provided on at least one blade of at least one of a stator and a rotor first row of blades and is fed via at least one line from a device for fluid removal on at least one blade of at least one of a stator and rotor further row of blades.

4. A fluid-flow machine in accordance with claim 1, and comprising a restrictor positioned in at least one of the lines.

5. A fluid-flow machine in accordance with claim 1, wherein at least one of the lines provides for free flow of the fluid.

6. A fluid-flow machine in accordance with claim 1, wherein the at least one blade is provided with a device for the variable control of a fluid flow area for at least one of the fluid removal and supply, respectively.

7. A fluid-flow machine in accordance with claim 1, wherein the line for returning the removed fluid is provided with a discharge chamber position at an inlet to the line.

8. A fluid-flow machine in accordance with claim 1, wherein the line for supplying the fluid is provided with a supply chamber at an outlet to the line.

9. A fluid-flow machine in accordance with claim 1, wherein, the blade is a variable stator blade, with a fluid supply channel and a fluid discharge channel being arranged within a spindle of the blade, the two channels leading into and out of the fluid flow, respectively, to at least one of a machine casing and a rotor hub, to provide for bi-functionality for the blade.

10. A fluid-flow machine in accordance with claim 2, and comprising a restrictor positioned in at least one of the lines.

11. A fluid-flow machine in accordance with claim 2, wherein at least one of the lines provides for free flow of the fluid.

12. A fluid-flow machine in accordance with claim 2, wherein the blade is provided with a device for the variable control of the fluid flow area for at least one of the fluid removal and supply, respectively.

13. A fluid-flow machine in accordance with claim 2, wherein the line for returning the removed fluid is provided with a discharge chamber positioned at an inlet to the line.

14. A fluid-flow machine in accordance with claim 13, wherein the line for supplying the fluid is provided with a supply chamber at an outlet to the line.

15. A fluid-flow machine in accordance with claim 3, and comprising a restrictor positioned in at least one of the lines.

16. A fluid-flow machine in accordance with claim 3, wherein at least one of the lines provides for free flow of the fluid.

17. A fluid-flow machine in accordance with claim 3, wherein the blade is provided with a device for the variable control of the fluid flow area for at least one of the fluid removal and supply, respectively.

18. A fluid-flow machine in accordance with claim 3, wherein the line for returning the removed fluid is provided with a discharge chamber positioned at an inlet to the line.

19. A fluid-flow machine in accordance with claim 18, wherein the line for supplying the fluid is provided with a supply chamber at an outlet to the line.

20. A fluid-flow machine in accordance with claim 2, wherein the device for fluid supply is fed via at least one line from a device for fluid removal on at least one blade of at least one of a stator and rotor second further row of blades.

21. A fluid-flow machine in accordance with claim 20, and comprising a restrictor positioned in at least one of the lines.

22. A fluid-flow machine in accordance with claim 20, wherein at least one of the lines provides for free flow of the fluid.

23. A fluid-flow machine in accordance with claim 20, wherein the blade is provided with a device for the variable control of the fluid flow area for at least one of the fluid removal and supply, respectively.

24. A fluid-flow machine in accordance with claim 20, wherein the line for returning the removed fluid is provided with a discharge chamber positioned at an inlet to the line.

25. A fluid-flow machine in accordance with claim 24, wherein the line for supplying the fluid is provided with a supply chamber at an outlet to the line.

* * * * *